US010270190B2

(12) United States Patent
Legault

(10) Patent No.: US 10,270,190 B2
(45) Date of Patent: Apr. 23, 2019

(54) TWIST-ON WIRE CONNECTOR

(71) Applicant: Thomas & Betts International LLC, Wilmington, DE (US)

(72) Inventor: Ludovic Legault, Pointe-Claire (CA)

(73) Assignee: Thomas & Betts International, LLC, Wilmington, DE (US)

( * ) Notice: Subject to any disclaimer, the term of this patent is extended or adjusted under 35 U.S.C. 154(b) by 0 days.

(21) Appl. No.: 15/880,666

(22) Filed: Jan. 26, 2018

(65) Prior Publication Data

US 2018/0248277 A1 Aug. 30, 2018

Related U.S. Application Data

(60) Provisional application No. 62/463,140, filed on Feb. 24, 2017.

(51) Int. Cl.

| | |
|---|---|
| ***H01R 4/12*** | (2006.01) |
| ***H01R 4/22*** | (2006.01) |
| ***H01R 4/48*** | (2006.01) |
| ***H01R 43/20*** | (2006.01) |

(52) U.S. Cl.

CPC ..... *H01R 4/4863* (2013.01); *H01R 4/12* (2013.01); *H01R 4/22* (2013.01); *H01R 4/48* (2013.01); *H01R 43/20* (2013.01)

(58) Field of Classification Search

CPC ..... H01R 4/4863; H01R 4/12; H01R 43/20
USPC ..... 174/75 R
See application file for complete search history.

(56) References Cited

U.S. PATENT DOCUMENTS

| | | | | |
|---|---|---|---|---|
| 3,519,707 | A | 7/1970 | Krup | |
| 3,743,087 | A | 7/1973 | Wise | |
| D233,891 | S | 12/1974 | Aldighieri | |
| 3,875,324 | A | 4/1975 | Waddington et al. | |
| 4,112,251 | A | 9/1978 | Scott | |
| 4,196,509 | A | 4/1980 | Del Rico | |
| 4,451,695 | A | 5/1984 | Fink | |
| 4,528,750 | A | 7/1985 | Fink | |
| 4,881,322 | A | 11/1989 | Finn et al. | |
| D315,143 | S | 3/1991 | Blaha | |
| 5,023,401 | A * | 6/1991 | Clifton | H01R 4/22 174/87 |
| 5,113,037 | A * | 5/1992 | King, Jr. | H01R 4/22 174/87 |
| 5,132,494 | A | 7/1992 | Burton et al. | |
| D339,106 | S | 9/1993 | McLaughlin et al. | |
| D366,866 | S | 2/1996 | Whitehead et al. | |
| 5,557,069 | A | 9/1996 | Whitehead et al. | |
| 5,557,070 | A * | 9/1996 | Tamm | H01R 4/22 174/74 A |

(Continued)

*Primary Examiner* — Timothy Thompson
*Assistant Examiner* — Michael F McAllister
(74) *Attorney, Agent, or Firm* — Taft Stettinius & Hollister; J. Bruce Schelkopf

(57) ABSTRACT

A twist-on wire connector includes a connector cap and a tapered coil spring configured to be secured within the connector cap. The connector cap includes a peripheral wall extending between open and closed ends of the connector cap and defining a connector cap recess, top portion having the closed end, bottom portion having the open end, and asymmetrically opposed wings. The asymmetrically opposed wings are positioned to offset from a centerline of the connector cap to provide a comfortable grip while turning the twist-on wire connector during electrical wire installation.

16 Claims, 8 Drawing Sheets

(56) References Cited

U.S. PATENT DOCUMENTS

| | | | | |
|---|---|---|---|---|
| 5,559,307 | A | 9/1996 | Whitehead et al. | |
| 5,559,322 | A | 9/1996 | Jacoby et al. | |
| D404,714 | S * | 1/1999 | Axelsson | D13/150 |
| 6,252,170 | B1 | 6/2001 | Korinek | |
| 6,414,243 | B1 * | 7/2002 | Korinek | H01R 4/22 174/87 |
| 6,677,530 | B2 | 1/2004 | Blaha et al. | |
| 7,365,270 | B2 | 4/2008 | Michaud et al. | |
| 2009/0283293 | A1 * | 11/2009 | Hiner | H01R 4/22 174/87 |

* cited by examiner

TWIST-ON WIRE CONNECTOR

CROSS REFERENCE TO RELATED APPLICATION

This application claims priority to U.S. Provisional Patent Application No. 62/463,140, filed on Feb. 24, 2017, the contents of which are incorporated herein by reference in its entirety.

FIELD OF THE INVENTION

The present invention relates to wire connectors, and more particularly, to twist-on wire connectors configured to provide more comfortable grip thereon and to facilitate easy installation of a spring within the twist-on wire connectors.

BACKGROUND OF THE INVENTION

Twist-on wire connectors are used to fasten a plurality of electrical wires. These connectors are available in various sizes and shapes, and each connector typically has a conical shape composed of insulative material. Generally, each of the twist-on wires currently available in the market includes a connector cap and a tapered coil spring. Some of the twist-on wire connectors further include a pair of opposed wings to provide a comfortable grip while installing/uninstalling electrical wires. These wings are typically aligned with the centerline of the connector cap such that they are spaced 180 degree apart. While the wings provide a grip for installer's fingers, this configuration of the wings does not provide a fully comfortable grip when turning the connector cap.

Typically, the tapered coil spring is secured within the connector cap by either screwing the spring into the connector cap with a tool such as a screwdriver or by heating the spring by induction. However, these spring assembly methods are difficult to perform, time consuming, and expensive.

Accordingly, although various twist-on wire connectors are available currently in the marketplace, further improvements are possible.

SUMMARY OF THE INVENTION

According to an embodiment of the present invention, a twist-on wire connector includes a connector cap and a tapered coil spring configured to be secured within the connector cap. The connector cap includes a peripheral wall extending between open and closed ends of the connector cap and defining a connector cap recess, top portion having the closed end, bottom portion having the open end, and asymmetrically opposed wings. The asymmetrically opposed wings are positioned to offset from a centerline of the connector cap to provide a comfortable grip while turning the twist-on wire connector during electrical wire installation.

According to a method aspect, a method of securing a tapered coil spring within a connector cap includes placing the tapered coil spring onto a punch such that the tapered coil spring is maintained in place by top and conical sections of the punch, inserting the punch with the tapered coil spring fully into the connector cap, and pulling out the punch from the connector cap.

These and other aspects of the present invention will be better understood in view of the drawings and following detailed description.

DETAILED DESCRIPTION OF PREFERRED EMBODIMENTS

Figure 1:
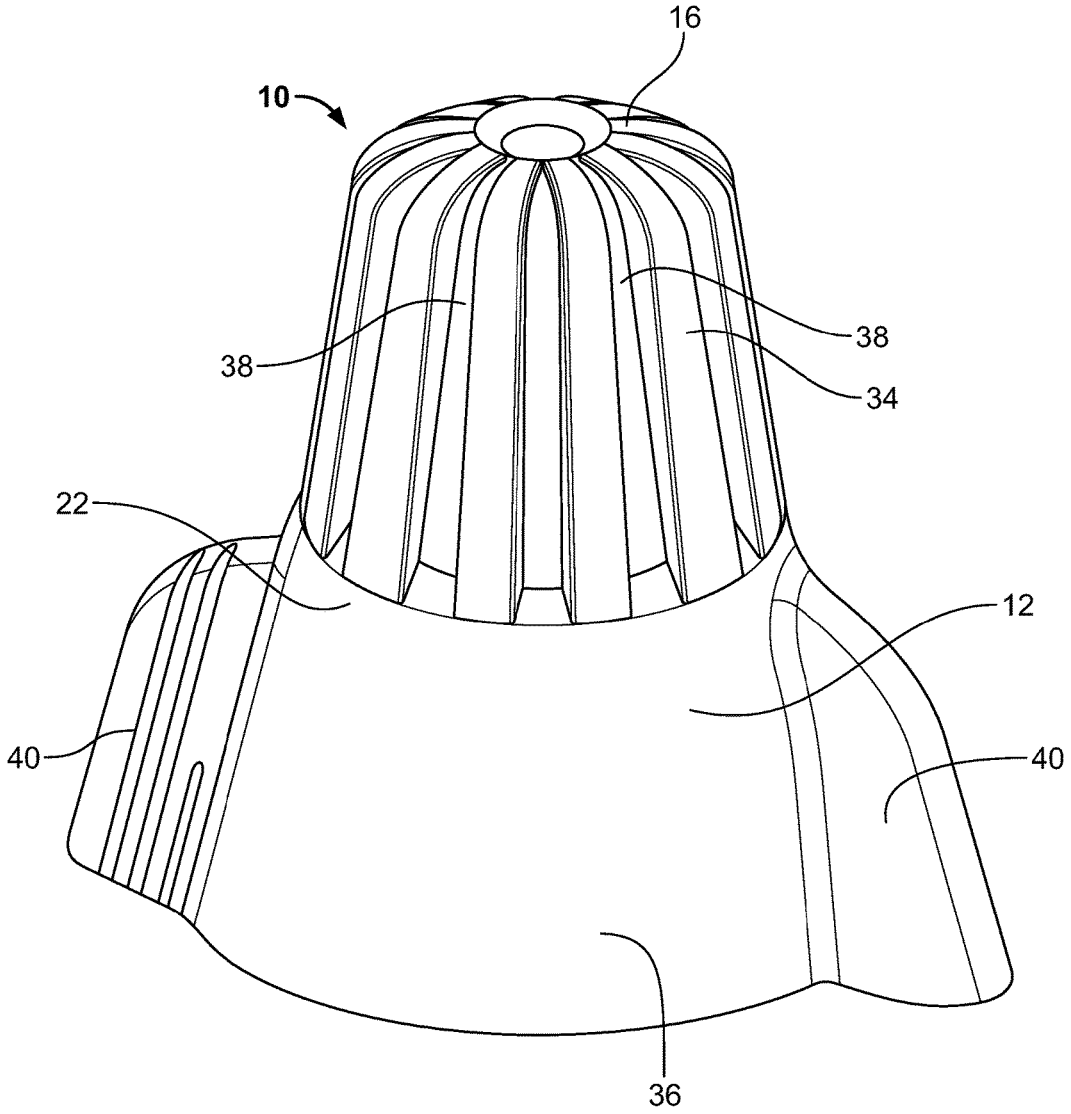
FIG. 1 is a perspective view of a twist-on connector, according to an embodiment of the present invention.
Figure 2:
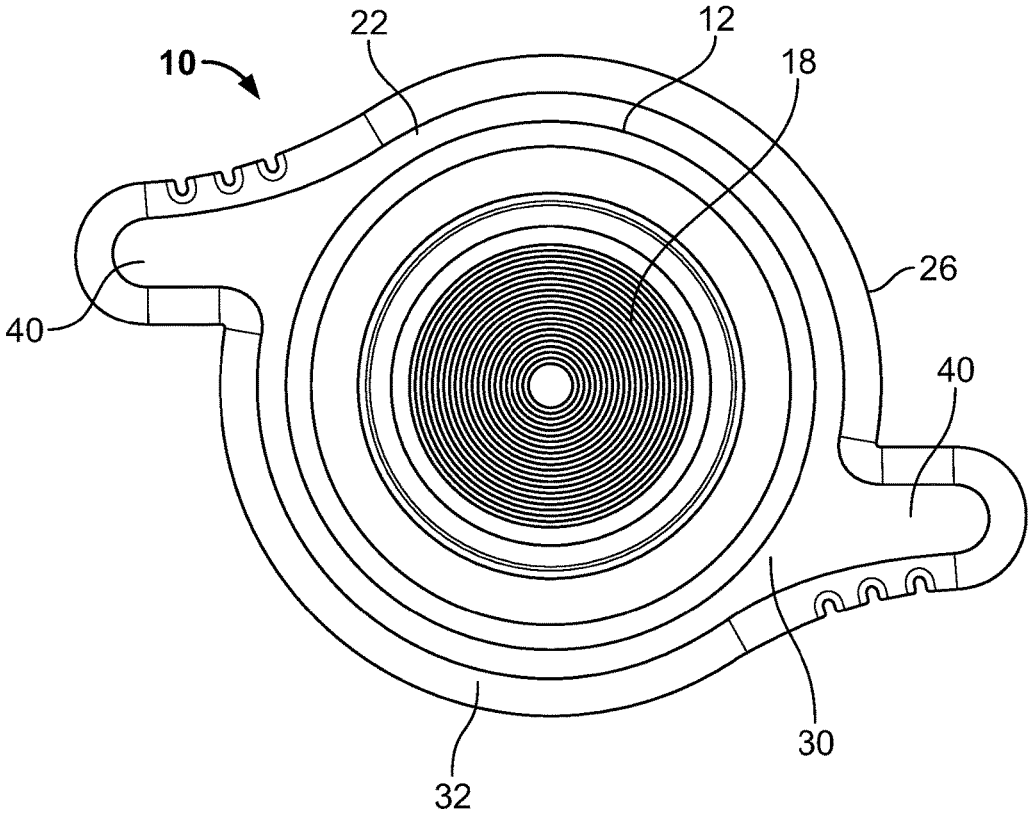
FIG. 2 is a bottom view of the twist-on connector in FIG. 1.
Figure 3:
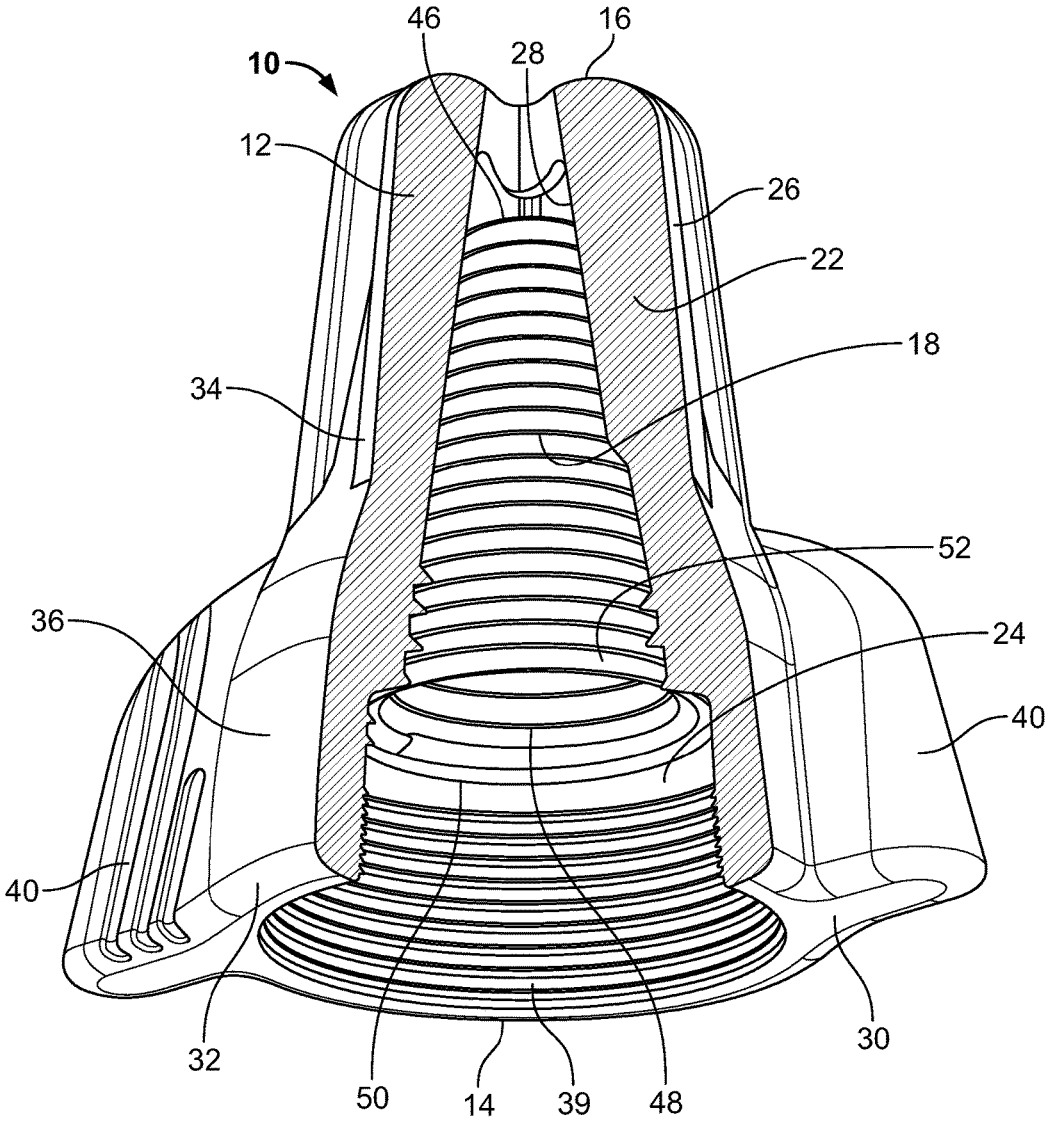
FIG. 3 is a sectional view of the twist-on connector in FIG. 1.

According to an embodiment of the present invention, referring to FIGS. 1-3, there is shown a twist-on wire connector 10 adapted and used for splicing the ends of electrical wires. The twist-on wire connector 10 includes a connector cap 12 having an open end 14 and a rounded closed end 16, and a tapered coil spring 18, which is designed and configured to be placed within the connector cap 12, as illustrated in FIGS. 2 and 3. The tapered coil spring 18 is secured within the connector cap 12 using a punch, as will be described in greater detail below.

Directional terms, such as top and bottom are referenced to an orientation in which the twist-on wire connector 10 is placed on a flat surface with the closed end 16 facing upwards. However, the present invention is not thereby limited to use in any particular orientation.

Figure 4:
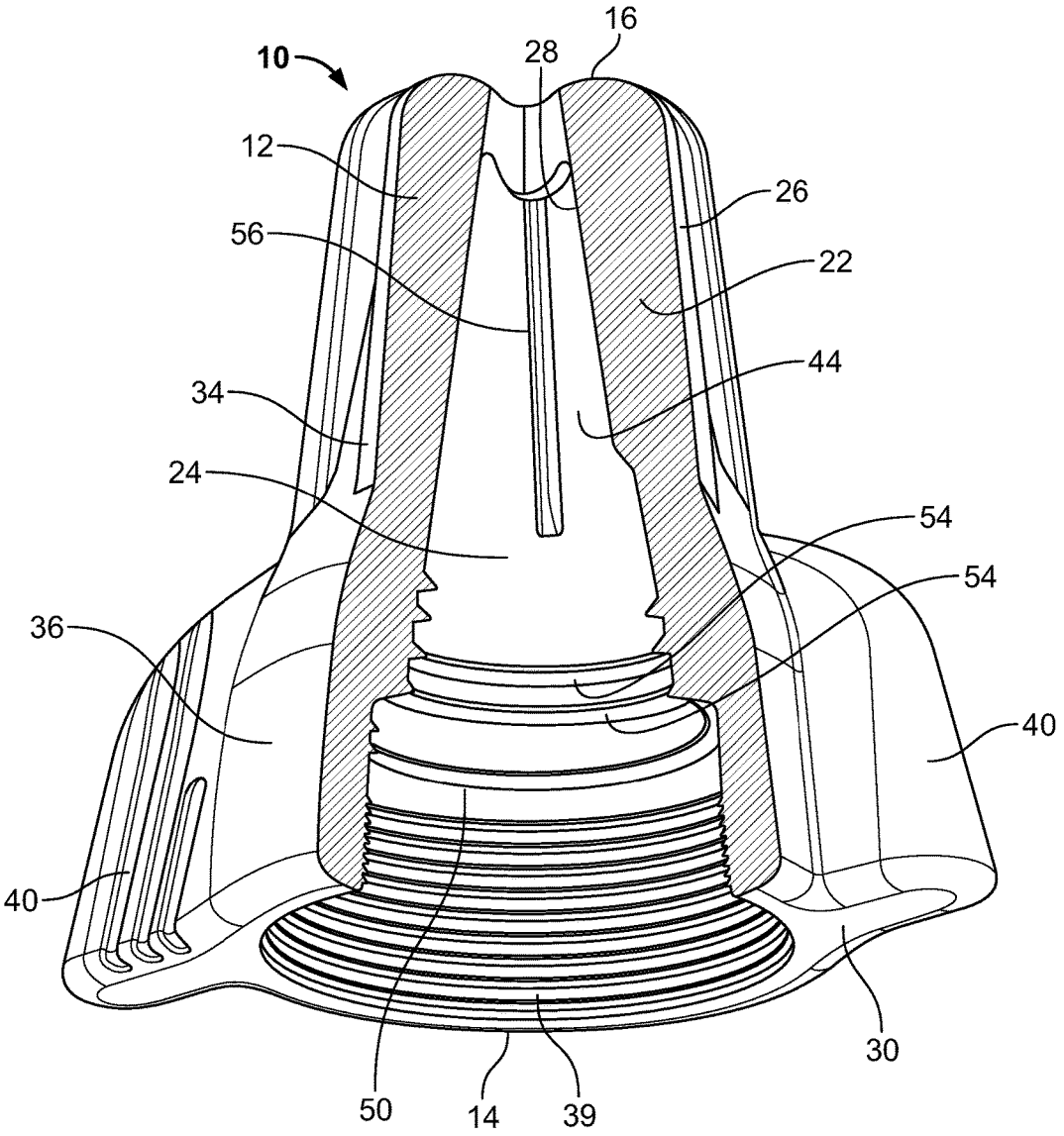
FIG. 4 is a sectional view of the connector cap in FIG. 1.

Referring to FIGS. 3 and 4, the connector cap 12 is generally hollow having a cylindrical or conical shape. The connector cap 12 includes a peripheral wall 22, which extends between the open end 14 and the rounded closed end 16, defining a connector cap recess 24 therebetween. The peripheral wall 22 has an outer surface 26, an inner surface 28, and a bottom surface 30. The outer surface 26 and the bottom surface 30 are connected by round transitions 32 to provide a smooth grip for installer's fingers when the installer turns the twist-on wire connector 10. The connector cap 12 tapers towards the rounded closed end 16.

The connector cap 12 is made of one or more materials having suitable properties for a desired application, including strength, weight, rigidity, electrical insulation, etc. Insulated molded material such as thermoplastic is generally preferred.

Figure 5:
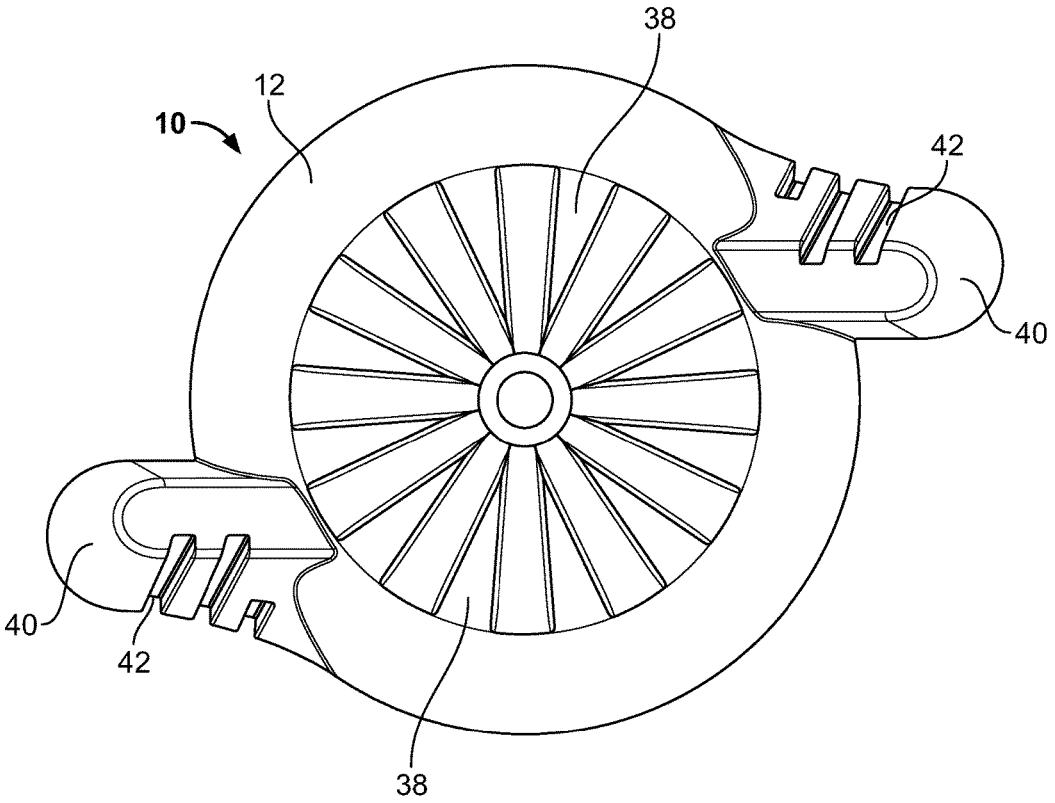
FIG. 5 is a top view of the connector cap in FIG. 1.

The connector cap 12 includes a top portion 34 having the closed end 16 to provide insulation for the electrical wires therewithin and a bottom portion 36 having the open end 14 to receive electrical wires. As shown in FIG. 5, a plurality of longitudinal cap grooves 38 are molded and evenly spaced on the outer surface of the top portion 34 of the connector cap 12 to provide a firm grip while installing/uninstalling the twist-on wire connector 10 from electrical wires.

The bottom portion 36 of the connector cap 12 is generally wider than the top portion 34 of the connector cap 12 and is slightly tapered inwardly to receive electrical wires to be spliced. The bottom portion 36 of the connector cap 12 includes a plurality of interior threads 39 formed about the open end 14 to assist with catching soft insulation of any electrical wires entering therethrough.

The connector cap 12 further includes a plurality of wings 40 that are integrally formed around the circumference of the bottom portion 36 of the connector cap 12 and extend radially outward adjacent to the open end 14, such that the plurality of wings 40 are undetachable from the bottom portion 36. In the preferred embodiment, the connector cap 12 includes a pair of asymmetrically opposed wings 40. More specifically, the wings 40 are positioned to offset from a centerline of the connector cap 12. Advantageously, the offset configuration of wings 40 provides more comfortable grip while turning the twist-on connector 10 than the conventional wing configuration, in which the wings 40 are aligned with the centerline of the connector cap 12 such that they are 180 degree apart. As shown in FIG. 5, a plurality of longitudinal wing grooves 42 are molded and evenly spaced on the outer surface of each of the plurality of wings 40 to provide a firm grip while installing/uninstalling the twist-on wire connector 10 from electrical wires.

Referring again to FIGS. 3 and 4, the top portion defines a top portion recess 44 to receive the tapered coil spring 18. The tapered coil spring 18 is a conical spiral and extends between a narrow open end 46 and a wide open end 48. A spring retaining flange 50 is defined on the inner surface of the connector cap 12 along an area, where the bottom portion 36 transitions into the top portion 34. When the tapered coil spring 18 is fully inserted into the top portion recess 44 of the connector cap 12, as illustrated in FIG. 3, a first coil 52 at the wide open end 48 of the tapered coil spring 18 abuts against the top surface of the spring retaining flange 50 to secure the tapered coil spring 18 within the top portion recess 44. Thus, the spring retaining flange 50 prevents the tapered coil spring 18 from popping out of the top portion recess 44. The tapered coil spring 18 and the top portion recess 44 are configured and dimensioned such that when the spring 18 is fully inserted into the connector cap 12, the tapered coil spring 18 is closely accommodated within the top portion recess 44.

A plurality of guiding threads 54 are defined immediately above the spring retaining flange 50. The plurality of guiding threads 54 prevent the tapered coil spring 18 from being loose and twisted inside the connector cap 12 as the twist-on wire connector 10 is turned to install/uninstall electrical wires.

Figure 6:
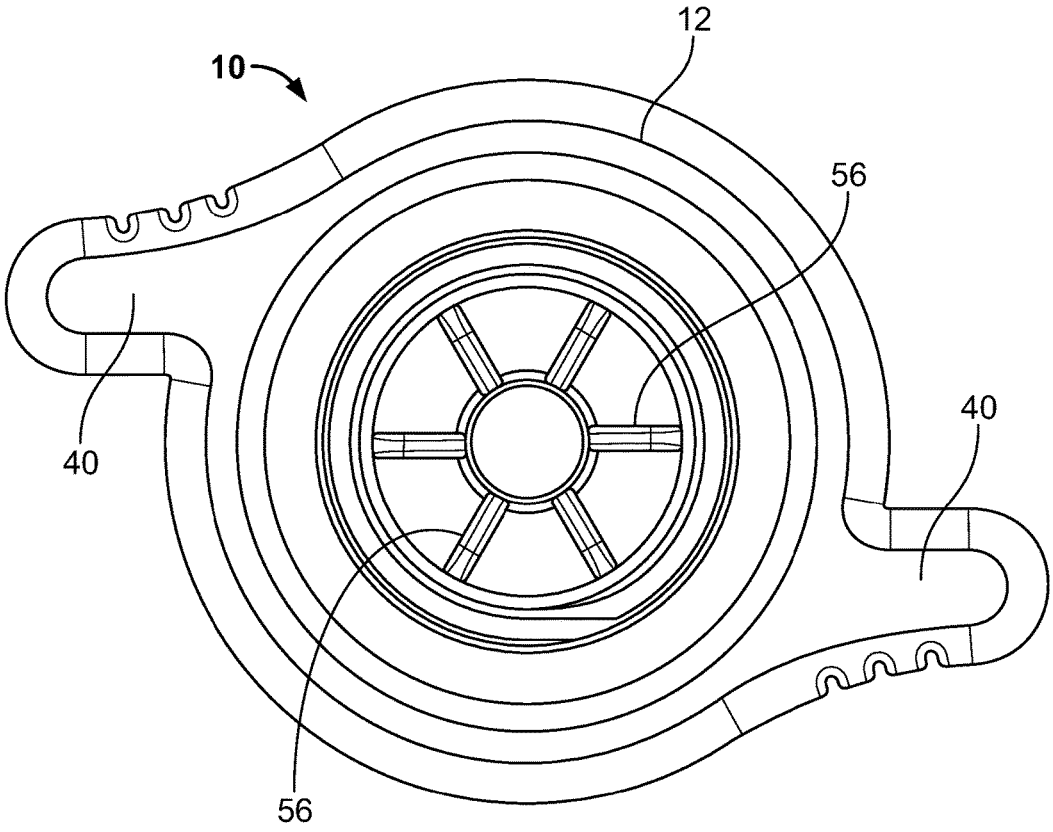
FIG. 6 is a bottom view of the connector cap in FIG. 1.

Referring to FIG. 6, the connector cap 12 further includes a plurality of longitudinal ribs 56 that are integrally formed from the inner surface of the top portion 34 and protrude outwardly therefrom. Each of the plurality of longitudinal ribs 56 extend from the closed end 16 and towards to the open end 14 of the connector cap 12. The plurality of longitudinal ribs 56 are preferably spaced substantially equally around the inner surface of the top portion 34 of the connector cap 12. During wire connector installation, as the twist-on wire connector 10 is turned onto the ends of electrical wires, torques applied by the installer is transferred to the connector cap 12 via the plurality of longitudinal ribs 56 to retain the tapered coil spring 18 in place and to prevent the spring 18 from twisting relative to the movement of the connector cap 12.

As stated above, in the present invention, the tapered coil spring 18 is secured within the top portion recess 44 of the connector cap 12 using a punch 58. This punching method for installing the tapered coil spring 18 within the connector cap 12 is advantageous since there is no need to screw the spring 18 or to heat the spring 18 by induction to secure it within the connector cap 12.

Figure 7:
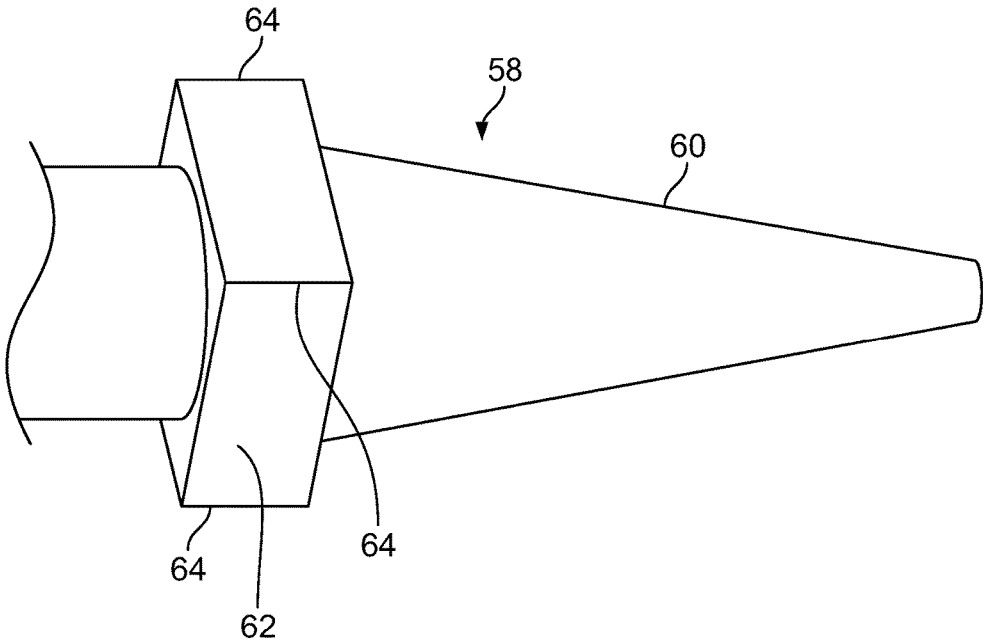
FIG. 7 is a perspective view of a punch used in installing the tapered coil spring in FIG. 2.
Figure 8:
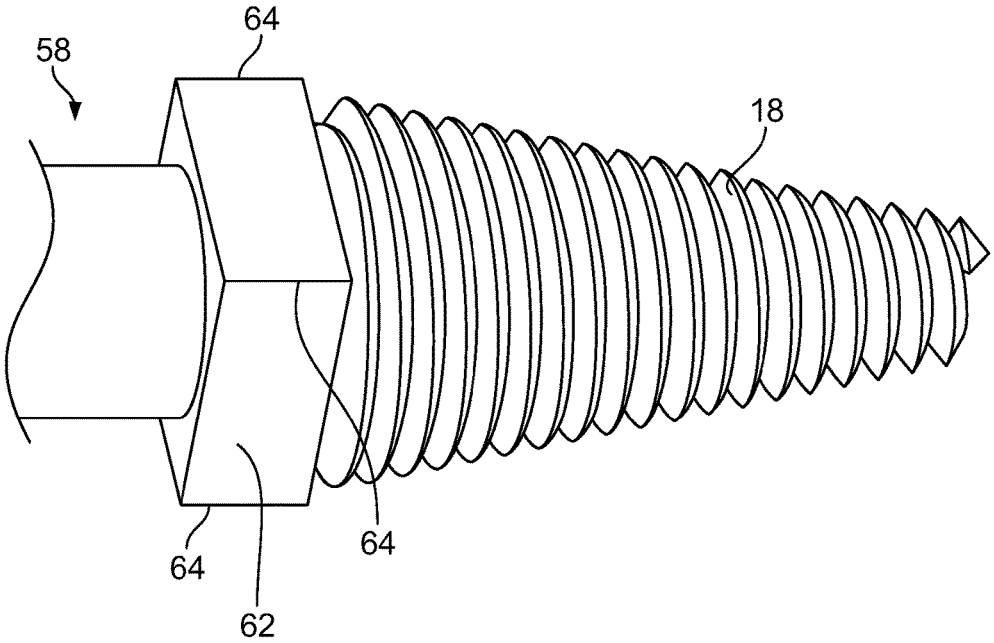
FIG. 8 is a perspective view of the punch with the tapered coil spring placed thereon.
Figure 9:
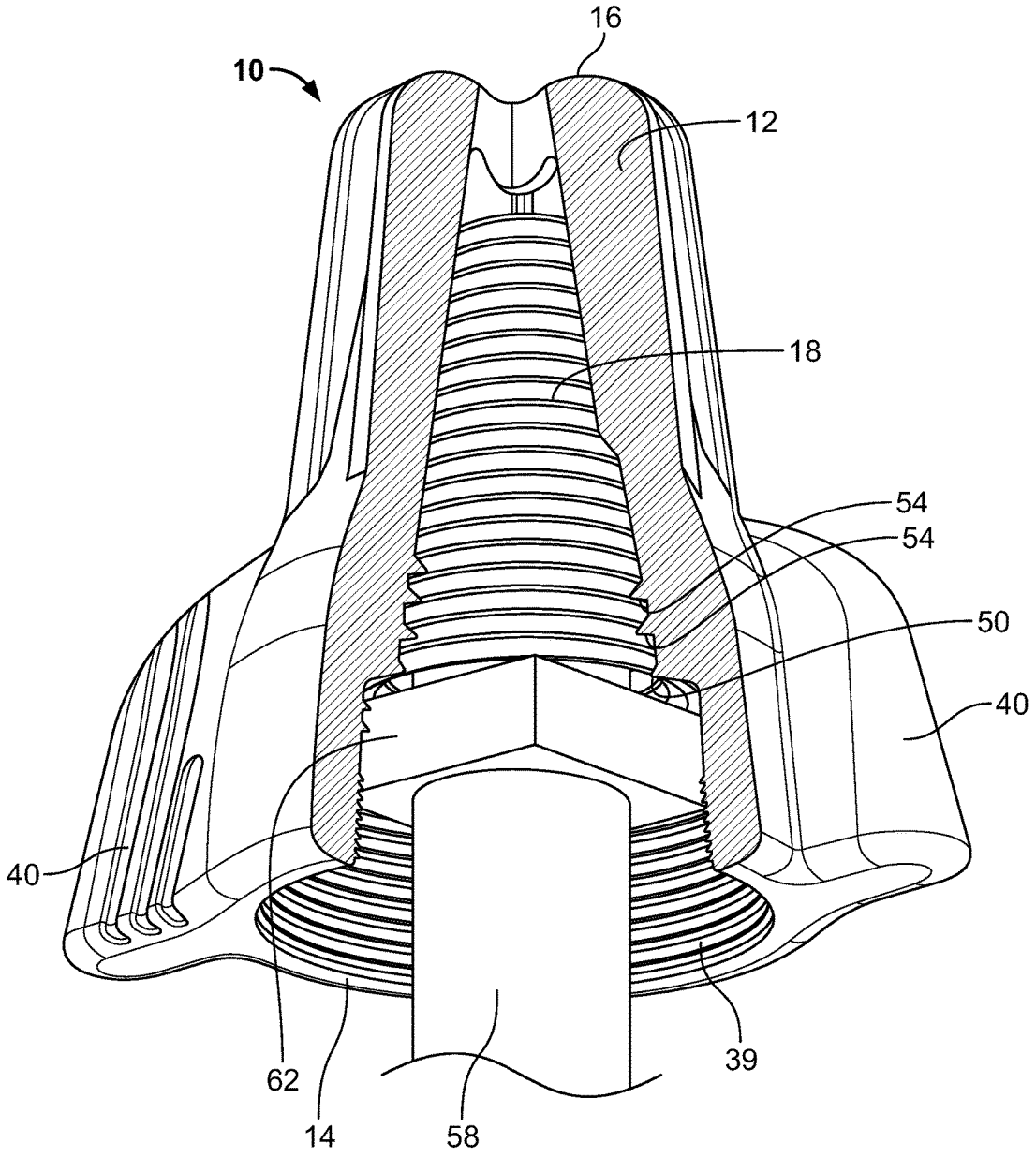
FIG. 9 is a sectional view of the twist-on connector in FIG. 1 with the punch in the connector cap.

During production of the twist-on connector 10, the punch 58, as shown in FIG. 7, is employed to punch and secure the tapered coil spring 18 under the spring retaining flange 50. Before inserting the tapered coil spring 18 in the connector cap 12, the spring 18 is placed around a conical section 60 of the punch 58, as shown in FIG. 8. During insertion of the tapered coil spring 18, the first coil 52 at the wide open end 48 of the tapered coil spring 18 is maintained in place by a top section 62 and the rest of coils are maintained on the conical section 60 by friction. Preferably, the top section 62 of the punch 58 has a square shape having a diagonal, which is larger than the diameter of the wide open end 48 of the tapered coil spring 18 to maintain it in place. Alternatively, the top section 62 of the punch 58 may be any other design (e.g., shape) and configuration suitable for inserting the tapered coil spring 18 into the connector cap 12 and secure it behind the spring retaining flange 50. Once the tapered coil spring 18 is punched, as illustrated in FIG. 9, each corner 64 of the top section 62 of the punch 58 creates a plastic deformation on the spring retaining flange 50 such that each plastic deformation prevents the tapered coil spring 18 from popping out of the top portion recess 44 of the connector cap 12.

From the foregoing, it will be appreciated that a twist-on wire connector according to the present invention provides an easy installation of electrical wire, while reducing time and cost for production.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A twist-on wire connector comprising:

a connector cap including:

a peripheral wall extending between an open end and a closed end of the connector cap, the peripheral wall having an inner surface that defines a connector cap recess, the inner surface further defining a spring retention flange and a plurality of guiding threads within the connector cap recess, the plurality of guiding threads positioned above, and separated from, the spring retaining flange, the spring retention flange having a closed configuration;

a top portion having the closed end, the plurality of guiding threads being positioned in the top portion of the connector cap;

a bottom portion having the open end;

asymmetrically opposed wings, each of the opposed wings integrally formed around the circumference of the bottom portion and extend radially outward adjacent to the open end, such that the wings are undetachable from the bottom portion; and a tapered coil spring configured to be secured within the connector cap recess, the spring retaining flange positioned and structured to secure the tapered coil spring within the connector cap recess;

wherein the asymmetrically opposed wings are positioned to offset from a centerline of the connector cap to provide a grip while turning the twist-on wire connector during electrical wire installation.

2. The twist-on wire connector of claim 1, wherein the peripheral wall includes an outer surface and a bottom surface, and wherein the connector cap recess extends through the bottom surface at the bottom portion.

3. The twist-on wire connector of claim 2, wherein the bottom surface and the outer surface are connected by round transitions to provide a smooth grip for installer's fingers when turning the twist-on wire connector, the round transitions being connected to the bottom surface at a location that is inwardly offset from a location of a connection between the round transition and the outer surface.

4. The twist-on wire connector of claim 1, wherein a plurality of longitudinal cap grooves are molded and evenly spaced on the outer surface of the top portion to provide a firm grip while installing/uninstalling the twist-on wire connector to/from electrical wires.

5. The twist-on wire connector of claim 1, wherein the bottom portion includes a plurality of interior threads formed about the open end to assist with catching soft insulation of electrical wires entering therethrough.

6. The twist-on wire connector of claim 1, wherein a plurality of longitudinal wing grooves comprise depressions that are molded into, and evenly spaced on, the outer surface of each of the plurality of wings to provide a firm grip while installing/uninstalling the twist-on wire connector to/from electrical wires.

7. The twist-on wire connector of claim 1, wherein the top portion defines a top portion recess to receive the tapered coil spring.

8. The twist-on wire connector of claim 1, wherein the tapered coil spring is a conical spiral and extends between a narrow open end and a wide open end.

9. The twist-on wire connector of claim 1, wherein the spring retaining flange is defined on the inner surface of the connector cap along an area where the bottom portion transitions into the top portion.

10. The twist-on wire connector of claim 1, wherein the tapered coil spring and the top portion recess are configured and dimensioned such that, when the tapered coil spring is inserted into the connector cap, it is closely accommodated within the top portion recess.

11. The twist-on wire connector of claim 9, wherein a plurality of guiding threads are configured to prevent the tapered coil spring from being loose and twisted inside the connector cap as the twist-on wire connector is turned.

12. The twist-on wire connector of claim 1, wherein the connector cap further includes a plurality of longitudinal ribs that are integrally formed from an inner surface of the top portion, protruding outwardly therefrom.

13. The twist-on wire connector of claim 12, wherein the plurality of longitudinal ribs extend from the closed end and towards to the open end of the connector cap to retain the tapered coil spring in place and to prevent the spring from twisting relative to the movement of the connector cap.

14. The twist-on wire connector of claim 1, wherein the connector cap is made out of insulated molded material such as thermoplastic.

15. The twist-on wire connector of claim 1, wherein the connector cap is conical.

16. The twist-on wire connector of claim 1, wherein the closed end is round.

* * * * *